United States Patent [19]

Paige

[11] 3,997,168

[45] Dec. 14, 1976

[54] RING AND CORD PUZZLE

[76] Inventor: David L. Paige, 2931 Switzer Road, Columbus, Ohio 43219

[22] Filed: Aug. 21, 1975

[21] Appl. No.: 606,465

[52] U.S. Cl. ..... 273/159

[51] Int. Cl.[2] ..... A63F 9/08

[58] Field of Search ..... 273/158, 159

[56] References Cited

UNITED STATES PATENTS

| | | | |
|---|---|---|---|
| 1,091,709 | 3/1914 | Rutledge | 273/158 |
| 2,998,253 | 8/1961 | Kranzusch | 273/158 |

*Primary Examiner*—Anton O. Oechsle

*Attorney, Agent, or Firm*—Mahoney & Stebens

[57] ABSTRACT

A ring and cord puzzle is provided having a rigid base formed with a plurality of upstanding posts and a plurality of rings articuately connected to respective ones of the posts and an elongated loop which is manipulated through the rings in working the puzzle. Each of the posts is rigidly fixed to the base thus forming a very stable platform during manipulation of the loop to facilitate solving the puzzle. The articulted connection of the rings to the posts in conjunction with at least a portion of the loop being formed from a flexible cord permits working of the puzzle.

5 Claims, 3 Drawing Figures

RING AND CORD PUZZLE

BACKGROUND OF THE INVENTION

Ring and cord or loop puzzles which involve the same manipulative operations as the puzzle illustrated and described herein have existed fo a substantial period of time. The principle of operation is substantially the same with respect to each of the known prior art structures and the manipulation in solving the puzzles follows the substantially same sequential procedure.

Examples of prior art puzzles of this type are disclosed in recently issued U.S. Pat. Nos. 3,881,732; 3,706,458; and 3,698,719. Each of these patented puzzles includes a base, a plurality of rings that are each connected with the base and are interrelated with a next adjacent ring. A rigid loop is provided for interlockingly coupling with all of the rings and is relatively manipulated to be disengaged from all of the rings. It will be noted that in U.S. Pat. 3,881,732, the base is not a unitary member but comprises enlarged discs connected with each ring. However, in each patented puzzle, the rings are connected to the base by means of separate post elements that are relatively movable to the other posts to permit operative manipulation of the rigid loop. This multiplicity of relatively movable elements renders these puzzles particularly difficult to work and substantially complicates the basic manipulative function to effect a solution of the puzzle.

Prior art puzzles of this type having rigid base, post and ring structures with a flexible cord loop are also known. Examples of this type are disclosed in U.S. Pat. Nos. 1,091,709and 2,324,566. These puzzles comprise structures that are difficult to fabricate and are not readily adapted to mass production techniques. Additionally, these puzzles are only workable with a completely flexible cord which can result in difficulty in maintaining the cord in proper relationship to the post and rings during working of the puzzle and these puzzles do not have the advantage of articulated rings.

SUMMARY OF THE INVENTION

A ring and cord puzzle of this type is provided by this invention which achieves the objectives of maintaining the complexity of the puzzle while reducing the mechanical dexterity required to manipulate the loop through the rings and about the posts. This advantageous structure capable of achieving these objectives includes a rigid base having a series of posts integrally formed therewith. Each of the rings is secured to a respective post by a flexible cord which results in an articulated connection which permits pivoting or swinging of the ring about two axis with the rings being supported at a fixed spacing relative to the base to further facilitate manipulation during working of the puzzle.

The integral formation of the base and upstanding posts results in a structure that can be readily and economically produced by plastic molding techniques. It is a relatively simple matter to then thread a flexible cord through the hollow posts and secure the rings to respective ones of the posts for articulated movement relative thereto.

These and other objects and advantages of this invention will be readily apparent from the following detailed description of the embodiment thereof and th accompanying illustrative drawing.

DESCRIPTION OF THE DRAWING FIGURES

DESCRIPTION OF THE ILLUSTRATED EMBODIMENT

Figure 1:
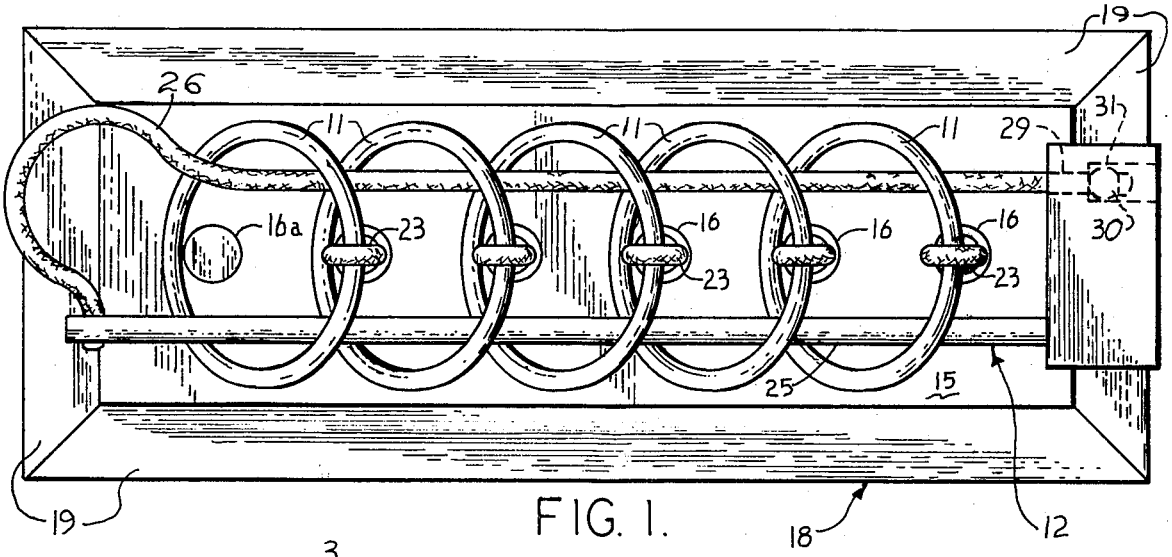
FIG. 1 is a top plan view of a puzzle embodying this invention.

Having reference to the drawing, a puzzle embodying this invention is shown and is seen to comprise a primary base 10 provided with a plurality of rings 11 and an elongated loop 12. The base 10 includes an elongated, inverted channel having vertical side and end walls 13 and 14 and an upper horizontal wall 15 integrally formed with the side and end walls. Also integrally formed with the horizontal wall 15 are a plurality of upstanding posts which project verticlly upward. These posts 16 are all of the same length and are longitudinally aligned along the center of the horizonatal wall 15 in uniformly spaced relationship. Each of the posts 16 excepting one end most post **16*a* is formed with a central, axially extending bore 17 which opens at the outer end of the post and at the interior of the base. The end post 16*a*** may be solid having a closed upper end.

In accordance with this invention, the base 10 is fabricated by plastic molding techniques utilizing an appropriate synthetic resin material. This integral formation of the base with the plurality of upstanding posts 16 and **16*a***results in economical manufacture while obtaining the necessary structural rigidity and strength required for a device of this type.

For purposes of aesthetic appearance, the illustrative embodiment incorporates a secondary base 18 on which the primary base 10 is supported. Forming the secondary base is a four-element peripheral frame 19 of decoratively finished wood and a bottom closure plate 20. Interconnection of the peripheral frame 19 with the primary base 10 is readily effected by an outwardly projecting rib 21 formed around the bottom exterior edge of the side and end walls 13 and 14. This rib 21 interlocks into a mating groove formed in the opposed inwardly facing surfaces of the peripheral frame. Assembly of the peripheral frame 19 with the primary base 10 is accomplished by fitting the four elements around the base with the rib 21 interfitting into the associated groove and then gluing the four frame elements into a unitary structure. The bottom closure plate 20 is glued into a peripherally extending recess formed around the interior surface of the peripheral frame 19.

Figure 2:
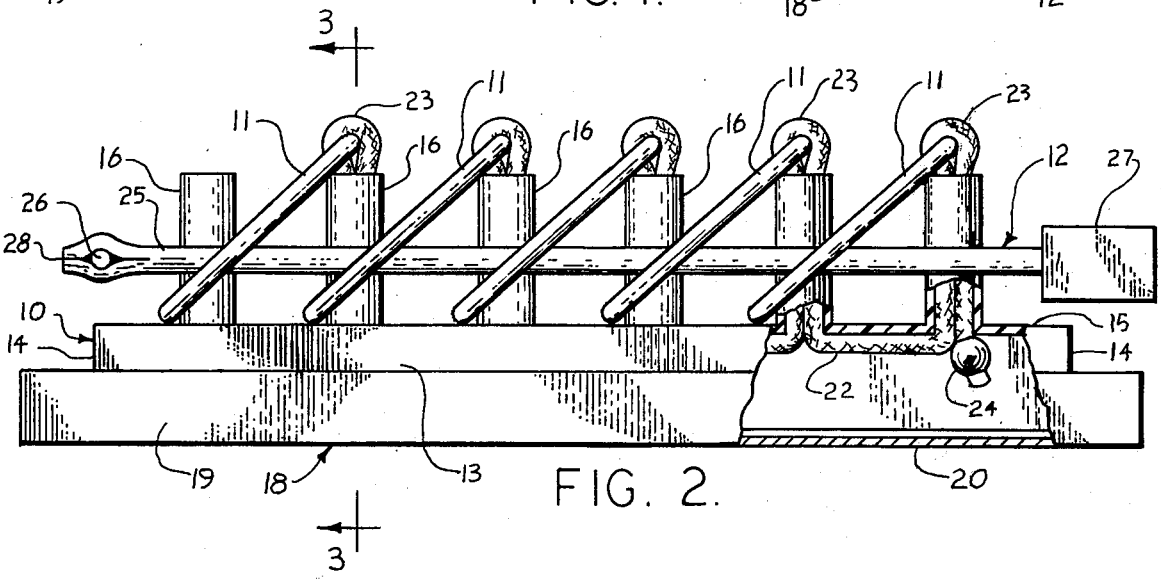
FIG. 2 is a side elevational view thereof with a portion of the base broken away.
Figure 3:
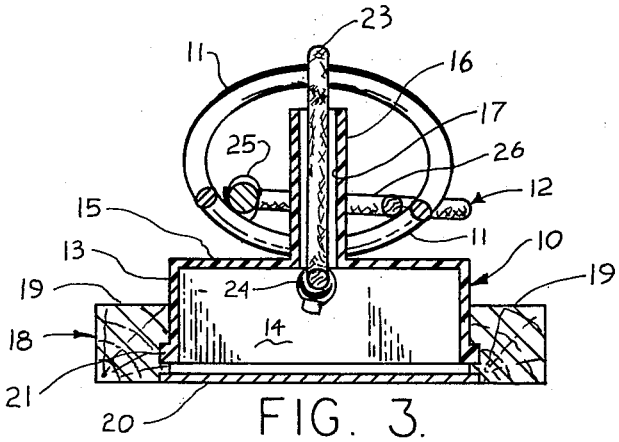
FIG. 3 is a sectional view taken along line 3—3 of FIG. 2.

A particularly advantageous mounting of the several rings 11 on their respective posts is attained by an elongated flexible cord 22. This cord 22 is easily threaded through the central bore 17 of each post 16 in succession. Bringing the cord upwardly through the posts and around a respective ring 11 forming a hinge loop 23 results in an effectively articulated connection. This connection permits swinging movement of the ring about a horizontal axis extending through the eye of the hinge loop 23 and a vertical axis extending through the post without restriction as a consequence of the inherent flexibility of the cord. Maintenance of the cord 22 in fixed association with the base 10 may be accomplished by either knotting the cord or, as in illustrative embodiment as shown in FIG. 2, crimping a split ball 24, such as a fishing line sinker, onto each of the free ends in close proximity to the inner end ot the bore 17. This ball 24 is of an appropriately sized diameter to prevent it from entering the bore 17 which is also occupied by another length of the cord.

Each of the rings 11 is of circular shape and of a diameter to extend from its articulated connection at the top of one post 16 into encircling relationship with the next adjacent post. Preferably, the rings 11 which may be fabricated from a material such as steel for rigidity, are of a diameter sufficiently large to project downwardly with side thereof diametrically opposite that secured by the hinge loop 23 capable of resting on the upper surface of the horizontal base wall 15.

Comprising the elongated loop 12 in the peferred embodiment is a rigid rod 25 and a length of flexible cord 26. The rod 25 is of a length to extend a distance beyond each of the end most posts 16 and **16*a* and is secured at one end in a socket formed in a connector block 27 which may be fabricated from wood. One end of the rod 25 opposite that secured in the connector block 27 is split at 28 and crimped around one end portion of the cord 26 into secure gripping relationship therewith. The opposite end of the cord 26 projects through a bore 29 and is prevented from being withdrawn by means of a split-ball 30 crimped onto the end portion. An enlarged counter bore 31 is formed in the connector block to receive the split ball 30**.

In initial assembly of the elongated loop 12 with the base 10 and rings 11, the loop may be only partially assembled such as by securing the flexible cord at one end only to either the split end 28 of the rod 25. The rigid rod may then be pushed through the several rings 11 along one side of the posts 16 and the cord 26 then returned along the other side of the posts and through the rings with the end then being secured into the connector block 27 as illustrated. This procedure obviates an assembly technique wherein the puzzle must be worked in a reverse manner as becomes necessarv when the puzzle is successfully worked.

With the puzzle assembled as illustrated in the drawing, a person may then proceed to manipulate the elongated loop 12 relative to the posts 16 and rings 11 in attempting to completely disengage the loop therefrom. The required manipulation procedure follows that utilized with the prior art devices and is well known to those familiar with such puzzles. It will be noted that the elongated loop may be readily manipulated with one hand to effect the necessary reciprocating movement. The loop 12 is gripped and supported by the connector block 27 and is easily reciprocated to appropriately position the opposite end relative to a post 16 and ring 11 to permit proper manipulation of the adjacent portions of the flexible cord 26 to achieve disengagement of the loop from the posts and rings.

It will be readily apparent that, a ring and cord puzzle of novel and advantageous structure is provided. The articulated connection of the rings to respective posts rigidly fixed to a base materially improves the operation and the operative techniques in effecting a solution of the puzzle. The structure is also economical to manufacture as a consequence of the novel molded base with integrally formed posts.

Having thus described this invention, what is claimed is:

1. A ring and cord puzzle comprising an elongated base having an upper surface and a plurality of upstanding fixed posts projecting a distance above said surface, said posts disposed in longitudinally aligned, spaced relationship, and formed with axially extending bores opening at the upper ends of the posts, a plurality of closed rings with each ring articulately secured to the upper end of a respective post by connector means cooperatively interengaging with the axial bore of a respective post, said rings being of a size to extend around a next adjacent post between the upper and lower ends thereof with at least all of said rings other than one endmost ring extending around a next adjacent post having a ring secured thereto, and an elongated loop having two longitudinally extending side members interconnected at each end of said loop, at least one of said side members being formed from a flexible cord and of a length relative to the other side member to permit manipulation thereof in working the puzzle.

2. A ring and cord puzzle comprising an elongated base having an upper surface and a plurality of upstanding fixed posts projecting a distance above said surface, said posts formed with an axially extending bore opening at their upper ends and at a bottom surface of said base and disposed in longitudinally aligned, spaced relationship, a plurality of closed rings with each ring articulately secured to the upper end of a respective post by a flexible cord looped around the rings, then extending through the axial bore and secured to said base at the bottom surface thereof, said rings being of a size to extend around a next adjacent post between the upper and lower ends thereof with at least all of said rings other than one endmost ring extending around a next adjacent post having a ring secured thereto and an elongated loop having two longitudinally extending side members interconnected at each end of said loop, at least one of said side members being formed from a flexible cord and a length relative to the other side member to permit manipulation thereof in working the puzzle.

3. A ring and cord puzzle according to claim 2 wherein said flexible cord for connecting said rings to said posts is of a length to extend through each of said bores in succession.

4. A ring and cord puzzle comprising an elongated base having an upper surface and a plurality of upstanding fixed posts projecting a distance above said surface, said posts disposed in longitudinally aligned, spaced relationship, a plurality of closed rings with each ring articulately secured to the upper end of a respective post and being of a size to extend around a next adjacent post between the upper and lower ends thereof with at least all of said rings other than one endmost ring extending around a next adjacent post having a ring secured thereto, and an elongated loop having two longitudinally extending side members interconnected at each end of said loop, one of said side members being an elongated, rigid rod of a length at least equal to the longitudinal extent of said posts and the other of said side members being formed from a flexible cord and of a length relative to the other side member to permit manipulation thereof in working the puzzle.

5. A ring and cord puzzle according to claim 4 wherein one end of the flexible side member is secured to one end of said rigid side member and the other ends of each are secured to a connector block.

* * * * *